United States Patent [19]

Nicholas

[11] Patent Number: 5,046,692

[45] Date of Patent: Sep. 10, 1991

[54] DEVICE FOR SUPPORTING RAINWATER GUTTER

[75] Inventor: Terry G. Nicholas, Chippenham, England

[73] Assignee: Wavin B.V, Netherlands

[21] Appl. No.: 443,329

[22] Filed: Nov. 30, 1989

[30] Foreign Application Priority Data

Dec. 7, 1988 [GB] United Kingdom ..... 8828608

[51] Int. Cl.[5] ..... E04D 13/00

[52] U.S. Cl. ..... 248/48.2; 52/11

[58] Field of Search ..... 248/48.2, 48.1, 222.3; 52/11, 94

[56] References Cited

U.S. PATENT DOCUMENTS

| | | | |
|---|---|---|---|
| 171,915 | 1/1876 | Brudoin | 248/48.1 |
| 505,717 | 9/1893 | Mundwiler | 248/48.1 |
| 948,901 | 2/1910 | Nakashjian | 248/48.1 |
| 2,590,030 | 3/1952 | Obert | 248/222.3 X |
| 3,150,851 | 9/1954 | Ritchie et al. | 248/48.2 |
| 3,296,749 | 1/1967 | Cotter | 248/48.2 X |
| 3,670,505 | 6/1972 | Weaver . | |
| 3,737,127 | 6/1973 | Maloney, Jr. et al. | 248/48.2 |
| 3,752,428 | 8/1973 | Trostle et al. . | |
| 4,460,299 | 7/1984 | Kowalski . | |
| 4,581,857 | 4/1986 | Harbom . | |
| 4,632,342 | 12/1986 | Skinner | 248/48.2 |
| 4,705,242 | 11/1987 | Yost . | |
| 4,776,544 | 10/1988 | Williams | 248/48.1 |

FOREIGN PATENT DOCUMENTS

| | | | |
|---|---|---|---|
| 1328769 | 4/1963 | France . | |
| 1021871 | 3/1966 | United Kingdom . | |
| 1065596 | 4/1967 | United Kingdom | 52/11 |
| 1153837 | 5/1969 | United Kingdom . | |
| 1246621 | 9/1971 | United Kingdom . | |
| 2192412A | 1/1988 | United Kingdom . | |

*Primary Examiner*—Karen J. Chotkowski

*Attorney, Agent, or Firm*—Wigman & Cohen

[57] ABSTRACT

A device 12 is provided for hangingly supporting a rainwater gutter 10 which has inturned top edges 20, 22. The device comprises a bracket 24 and a support member 42 pivotally attached thereto. The support member has opposite ends 48 which locate under the inturned top edges of the gutter when the member is pivoted to a predetermined position relative to the bracket.

6 Claims, 2 Drawing Sheets

DEVICE FOR SUPPORTING RAINWATER GUTTER

This invention relates to a device for supporting a rainwater gutter.

Conventionally rainwater gutter support devices have comprised channel-shaped portions for receiving and supporting the gutter. Such devices extend over the outer face of the gutter and detract from the appearance thereof. More recently, gutter support devices have been devised which hangingly support the gutter such that the device does not extend over at least the majority of the front face thereof. However these support devices rely on snap-fitted engagement with the edges of the gutter to hang the gutter and are not readily disconnectable from the gutter to allow demounting thereof.

An object of the present invention is to provide a device for hangingly supporting a gutter which does not rely on a snap-fit with the gutter.

To this end, the invention provides a device for hangingly supporting a rainwater gutter having inturned top edges, the device comprising bracket means and support means attached, or attachable, to the bracket means and positionable relative thereto to locate at least under the inturned top edges of the gutter.

Preferably, the support means is pivotally attached to the bracket means and pivotable relative thereto for locating at least under the inturned top edges of the gutter.

The support means may comprise an elongate member, opposite ends of which are adapted to locate at least under the inturned top edges when the member is pivoted to a predetermined position relative to the bracket means.

The opposite ends of the member may define with the bracket means respective channels for receiving the inturned top edges of the gutter.

Preferably, the bracket means includes respective abutment portions for abutting the outer surfaces of the gutter adjacent the inturned top edges thereof for retaining the inturned top edges in said channels.

The elongate member may be provided with a respective lug means adjacent each of said opposite ends thereof adapted to locate over an upper surface portion of the bracket means when the member is in said predetermined position.

Releasable snap-fitting means may be provided on said bracket means and elongate member for releasably retaining said member in said predetermined position. Furthermore, when the elongate member is provided with lug means as aforesaid, these releasable snap-fitting means may be provided on at least one of said lug means and at least one of the upper surface portions of the bracket means over which the lug means locate when the member is in said predetermined position.

In order that the invention may be well understood, an embodiment thereof, which is given by way of example only, will now be described with reference to the accompanying drawings, in which:

FIG. 1 a top plan fragmentary view of a rainwater gut to which a hanging support device is fitted;

Figure 1:
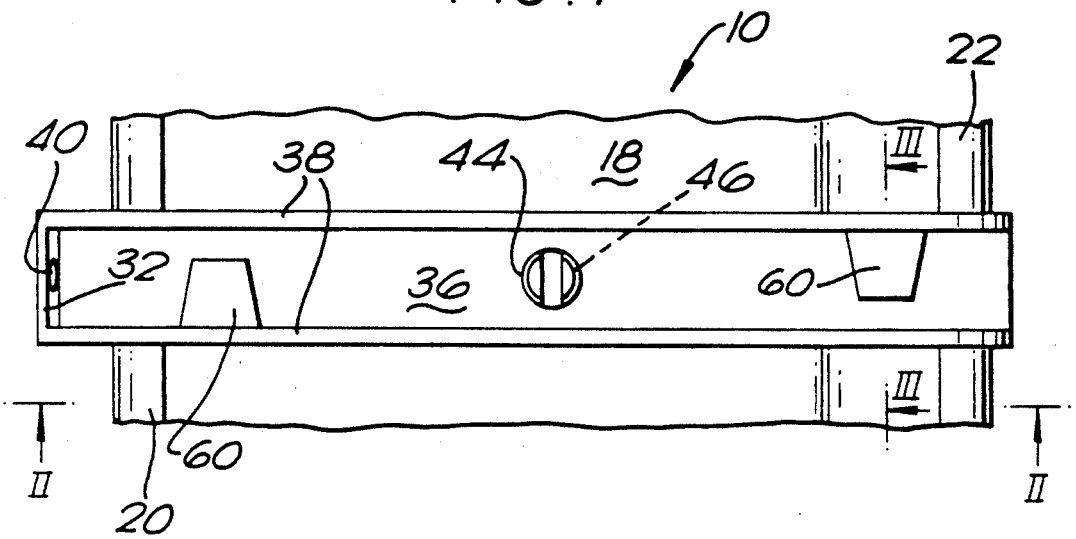
Figure 2:
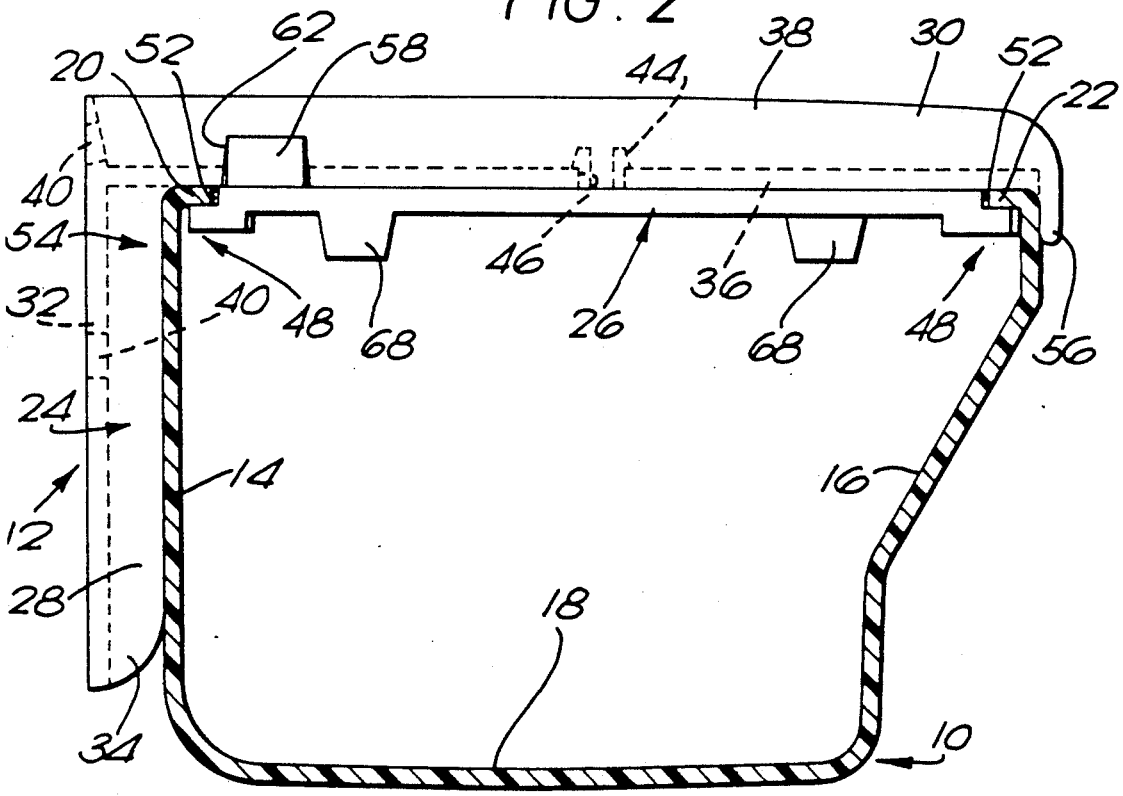
FIGS. 2 and 3 are respectively views taken along lines II—II and III—III in FIG. 1.
Figure 3:
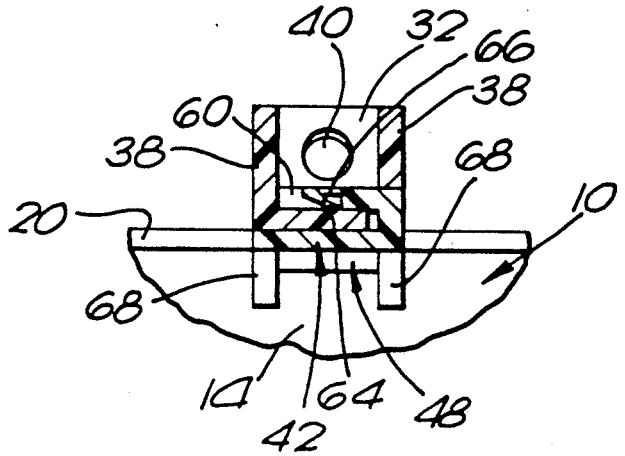

Referring first to FIGS. 1 to 3, there is shown a portion of a length of gutter 10 to which is fitted a device 12 for hangingly supporting the gutter. The gutter is channel-shaped, with back and front side walls 14 and 16 extending from a base wall 18 to top edges 20 and 22 which are inturned. The gutter is extruded from a plastics material such as UPVC.

The device 12 generally comprises bracket means 24 and support means 26 attached to the bracket means and positionable relative thereto to locate at least under the inturned top edges 20, 22 of the gutter to support the gutter relative to the bracket means.

In the embodiment disclosed the support means 26 is pivotally attached to the bracket means 24 and pivotable relative thereto in order to locate at least under the gutter inturned top edges.

In more detail, as shown, the bracket means 24 comprises a bracket member injection moulded in one piece from a plastics material, such as a UPVC, and comprising a mounting portion 28 and a cantilever portion 30 extending from one end of the mounting portion. Both portions 28 and 30 are elongate and of channel section, the mounting portion 28 having a base 32 and two sides 34, and the cantilever portion 30 having a base 36 and two sides 38.

The base 32 of the mounting portion is provided with through-holes 40 for the passage of fixing devices, such as screws, to enable the mounting portion to be mounted against a vertical surface, such as that of a facia board. As indicated in FIG. 2, in use, the bracket member is mounted against such a vertical surface so that the mounting portion 28 extends downwardly from the cantilever portion 30 and the channel section of the cantilever portion opens upwardly.

Figure 4:
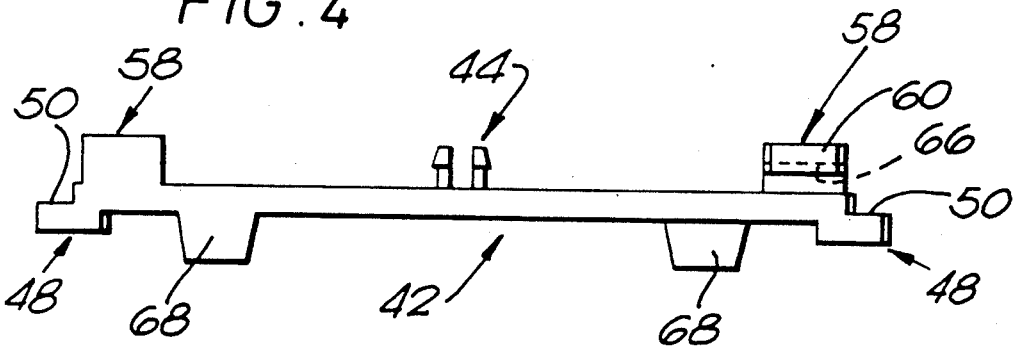
FIG. 4 is a side view of one of the members of the device.

The support means 26 comprises a single elongate member 42, shown separately in FIG. 4, which is injection moulded from a plastics material such as a UPVC. The member 42 is provided with an integral pivot 44 which is snap-fittable into a circular hole 46 provided in the base 36 of the bracket cantilever portion 30 in order to pivotally attach the elongate member 42 to the bracket member. When so attached, the member 42 can be pivoted to a predetermined position relative to the bracket member, as shown in FIGS. 1 to 3, such that the opposite ends 48 of the elongate member locate under the inturned top edges 20, 22 of the gutter. As illustrated, the ends 48 of the member 42 are stepped to provide surface portions 50 which locate under the inturned top edges 20, 22. It will also be noted that the stepped opposite ends 48 of the member 42 define with the bracket member respective channels 52 in which the inturned top edges 20, 22 of the gutter are received. Furthermore it will be noted from FIG. 2 that the bracket member includes respective abutment portions 54, 56 which abut the outer surfaces of the gutter adjacent the inturned top edges 20, 22 thereof thereby retaining the inturned top edges in the channels 52. The abutment portion 54 comprises the edges of the sides 34 of the mounting portion 24 and the abutment portion 56 comprises a downturned end portion of the cantilever portion 30.

The elongate member 42 is provided with a respective lug means 58 adjacent each of its opposite ends 48 adapted to locate over an upper surface portion of the base 36 of the bracket cantilever portion 30 when the member 42 is in the aforementioned predetermined position as illustrated in FIGS. 1 to 3. The respective lug means 58 are mounted on opposite edges of the elongate member and each comprises a tab 60 which extends parallel to but is spaced from the upper surface of the elongate member 42. Respective openings 62 provided on opposite sides of the cantilever portion 30 in the sides 38 and base 36 thereof allow the tabs to pass through the sides 38 and locate over the upper surface of the base 36. The lug means 58 of the elongate member 42 are equidistant from the pivot axis of the pivot 44 thereof and the openings 62 in the bracket cantilever portion 30 are equidistant from the axis of the circular opening 46 therein. Accordingly, it will be appreciated that the elongate member may be snap-fitted either way round into the bracket cantilever portion. It will be appreciated that engagement of the tab 60 with the upper surface of the bracket cantilever portion base 36 prevents downward deflection of the end portions 48 of the elongate member which might otherwise occur when the gutter is heavily loaded.

In order to prevent the elongate member pivoting out of its predetermined position relative to the bracket member due to thermal movement of the gutter, snap-fitting means are provided on the bracket member and elongate member for releasably retaining the elongate member in this predetermined position.

In the embodiment these releasable snap-fitting means comprise projection means on the upper surface of the bracket mounting portion base 36 and recess means provided in the undersurface of the tabs 60.

As illustrated a single projection 64 is provided on one of the upper surface portions of the base 36 over which the tabs locate, but both tabs 60 are provided with recesses 66. It will be appreciated that the provision of the recesses 66 in both tabs is required since otherwise the elongate member cannot be fitted to the bracket mounting portion either way round. The elongate member 42 is also provided adjacent each of its lug means with a flange 68 to facilitate pivoting of the elongate member relative to the bracket member.

Figure 5:
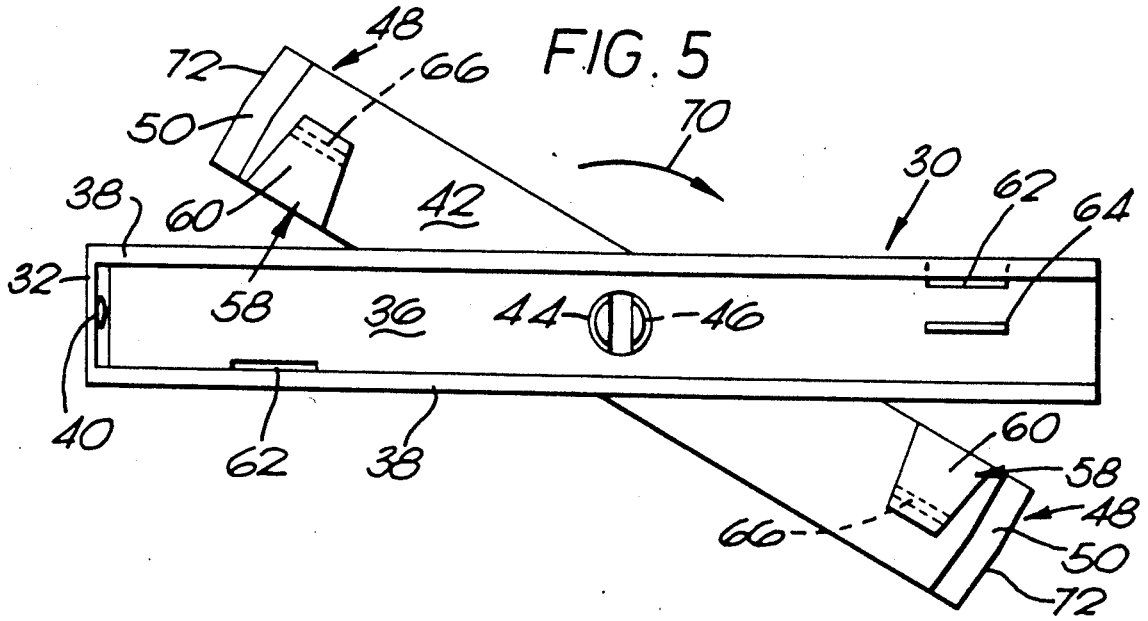
FIG. 5 is a top plan view of the device in an open condition prior to having the gutter fitted thereto.

In order to use the device 12 to hangingly support a length of gutter, if the bracket means 24 and the support means 26 are not already assembled together, the elongate member 42 is pivotally attached to the cantilever portion 30 of the bracket member by snap-fitting the pivot 44 into the circular hole 46 in the bracket cantilever portion 30. Thereafter the bracket member is mounted against a vertical surface using fixing means passing through the through-holes 40 in the manner described above such that the mounting portion 28 extends downwardly from the cantilever portion 30. The gutter is then offered up to the bracket member and positioned such that the inturned edges 20, 22 are located against the under surface of the base 36 of the bracket cantilever portion. Thereafter the elongate member 42 is pivoted from a position, such as that illustrated in FIG. 5 in the direction of the arrow 70 into the predetermined position illustrated in FIGS. 1 to 3 so that the stepped ends 48 of the elongate member locate under the inturned top edges 20, 22 of the gutter. It will be noted from FIG. 5 that the leading portions of the ends 48 so far as the pivotal movement is concerned are chamfered as indicated at 72 to facilitate movement of the elongate member into alignment with the bracket mounting portion as illustrated in FIGS. 1 to 3. Pivotal movement beyond this aligned position is prevented by engagement of the lug means 58 with the side edges of the bracket cantilever portion and the member 42 is retained in this aligned position by snap-engagement of the recess 66 formed in the tab 60 furthest away from the bracket mounting portion with the projection 64 formed on the upper surface of the bracket mounting portion base 36. This snap-fitting engagement prevents pivotal movement of the elongate member 42 relative to the bracket cantilever portion 30 due, for example to thermal movement of the gutter, once the gutter has been fitted to the device but is readily releasable for example by inserting a wedge under the tab 60 to enable the elongate member to be pivoted relative to the bracket cantilever portion 30 to move the stepped ends 48 thereof from their location under the inturned top edges 20, 22 of the gutter and thereby enable the gutter to be demounted from the device 12.

It will be understood from the above that the device itself is not snap-fitted to the gutter and that the snap-fitting arrangement between the elongate member 42 and bracket member is readily disconnectable without applying any undue stress either to the gutter or the parts of the device which are engaged by the gutter.

Whilst in the illustrated embodiment the support means is constituted by a single elongate member 42 pivotally attached to the bracket means, it is to be understood that respective members pivotally or otherwise attached to the bracket means could be provided for cooperation with the two inturned top edges of the gutter. Additionally, it will also be appreciated that the member(s) forming the support means of the device may define channels for receiving the inturned top edges of the gutter and thereby locates not only under those edges but also over them.

I claim:

1. A device for hangingly supporting therefrom a rainwater gutter having inturned top edges, the device comprising bracket means and support means attached, or attachable, to the bracket means and retainably positionable relative thereto by releasable cooperable snap-fitting means on said bracket means and support means to hangingly support the gutter by location at least under the inturned top edges of the gutter, means for pivotally attaching the support means to the bracket means and pivotable relative thereto for locating at least under the inturned top edges of the gutter, said support means comprising an elongate member, opposite ends of which are adapted to locate at least under the inturned top edges when the member is pivoted to a predetermined position relative to the bracket means, said opposite ends of said elongate member defining with said bracket means respective channels for receiving the inturned top edges, said bracket means including respective abutment portions for abutting the outer surfaces of the gutter adjacent the inturned top edges thereof for retaining the inturned top edges in said channels, and said bracket means forming a wall of each respective channel in cooperation with the ends of said elongate member which form an opposing wall of a respective channel.

2. A device for hangingly supporting therefrom a rainwater gutter having inturned top edges, the device comprising bracket means and support means attached, or attachable, to the bracket means and retainably positionable relative thereto by releasable cooperable snap-fitting means on said bracket means and support means to hangingly support the gutter by location at least under the inturned top edges of the gutter, means for pivotally attaching the support means to the bracket means and pivotable relative thereto for locating at least under the inturned top edges of the gutter, said support means comprising an elongate member, opposite ends of which are adapted to locate at least under the inturned top edges when the member is pivoted to a predetermined position relative to the bracket means, said elongate members provided with a respective lug means adjacent each of said opposite ends thereof adapted to locate over an upper surface portion of the bracket means when the member is in said predetermined position.

3. A device as claimed in claim 2, wherein said releasable snap-fitting means are provided on at least one of said lug means and at least one of the upper surface portions of the bracket means over which the lug means locate when the member is in said predetermined position.

4. A device for hangingly supporting a rainwater gutter having inturned top edges, the device comprising bracket means and an elongate member pivotally attached to the bracket means and pivotable relative thereto such that opposite ends of said elongate member hangingly support the gutter by location under the inturned top edges of the gutter, the elongate member pivoted to a predetermined position relative to the bracket means thereby cooperating with the bracket means to define respective channels at the opposite ends for receiving the inturned top edges of the gutter.

5. A device for hangingly supporting a rainwater gutter having inturned top edges, the device comprising bracket means and an elongate member having opposite ends and pivotally attached to the bracket means and pivotable relative thereto, said opposite ends of said elongate member engaging the gutter by location under the inturned top edges of the gutter when the member is pivoted to a predetermined position relative to the bracket means, said elongate element being provided with a respective lug means adjacent at least one of the opposite ends thereof adapted to locate over an upper surface portion of the bracket means when the member is in said predetermined position.

6. A device for hangingly supporting a rainwater gutter having inturned top edges, the device comprising bracket means and an elongate member pivotally attached to the bracket means and pivotable relative thereto such that opposite ends of said elongate member hangingly support the gutter by location under the inturned top edges of the gutter, said elongate member cooperating with said bracket means to engage the inturned top edges of the gutter when the member is pivoted to a predetermined position relative to the bracket means, and further comprising releasable snap-fitting means provided on said bracket means and elongate member for releasably retaining said member in said predetermined position.

* * * * *